US006661392B2

(12) United States Patent
Isaacs et al.

(10) Patent No.: US 6,661,392 B2
(45) Date of Patent: Dec. 9, 2003

(54) RESONANT ANTENNAS

(75) Inventors: Eric D Isaacs, Short Hills, NJ (US); Philip Moss Platzman, Short Hills, NJ (US); Jung-Tsung Shen, Waltham, MA (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/090,106

(22) Filed: Mar. 4, 2002

(65) Prior Publication Data

US 2003/0034922 A1 Feb. 20, 2003

Related U.S. Application Data

(60) Provisional application No. 60/313,310, filed on Aug. 17, 2001.

(51) Int. Cl.[7] ..... H01Q 15/08

(52) U.S. Cl. ..... 343/911 R; 343/753; 343/911 L

(58) Field of Search ..... 343/703, 702, 343/753, 911 L, 911 R

(56) References Cited

U.S. PATENT DOCUMENTS

| | | | | |
|---|---|---|---|---|
| 3,543,271 A | * | 11/1970 | Scheel | 343/705 |
| 3,765,024 A | * | 10/1973 | Chiron et al. | 342/368 |
| 4,090,198 A | * | 5/1978 | Canty et al. | 342/6 |
| 6,002,368 A | | 12/1999 | Faraone et al. | 343/700 |
| 6,046,701 A | * | 4/2000 | Carey et al. | 343/753 |
| 6,424,319 B2 | * | 7/2002 | Ebling et al. | 343/911 L |
| 6,473,050 B2 | * | 10/2002 | Foncin | 343/754 |

OTHER PUBLICATIONS

Johnson, R. Colin: *'Metamaterial 'holds psromise for antennas, optics*, http://www.eetimes.com/story/OEG20010430S0110, EE Tiimes, Apr. 30, 2001, pp. 1–2.

Smith, D. R. et al: *Composite Medium with Simultaneously Negative Permeability and Permittivity*, Physical Review Letters, vol. 84, No. 18, May, 2000, pp. 4184–4187.

Shelby, R. A. et al: *Microwave Transmission Through A Two–dimensional, Isotropic, Left–handed, Metamaterial*, Applied Physics Letters, vol. 78, No. 4, Jan., 2001, pp. 489–491.

Shelby, R. A. et al: *Experimental Verification of a Negative Index of Refraction*, Science, vol. 292, Apr., 2001, pp. 77–79.

Smith, D. R. et al: *Loop–wire Medium for Inventigating Plasmons at Microwave Frequencies*, Applied Physics Letters, vol. 75, No. 10, Sep., 1999, pp. 1425–1427.

Smith, D. R., et al.: *Negative Refractive Index in Left–Handed Materials*, Physical Review Letters, vol. 85, No. 14, Oct., 2000, pp. 2933–2936.

Smith, D. R., et al: *Direct Calculation of Permeability and Permittivity for a Lefty–handed Metamaterial*, Applied Physics Letters, vol. 77, No. 14, Oct., 2000, pp. 2246–2248.

Pendry, J. B. et al: *Extremely Low Frequency Plasmons in Metallic Mesostructures*, Physical Review Letters, vol. 76, No. 25, Jun., 1996, pp. 4773–4776.

*Meeting Invitation For Darpa Meta–Materials Workshop*, http://www.sainc.com/conference/View/Invitation.asp, Greenbelt, MD, Sep., 2000, 2 pages.

UCSD Press Release, *UCSD, Physicists Develop New Class of Composite Materials with 'Reversed' Physical Properties Never Before Seen*, Press Conference, Minneapolis, MN, Mar., 2001, 3 pages.

*Left Handed Materials*, http://physics.ucsd.edu/~rshelby/lh-media/intro.html, Mar., 2000, 3. pages.

* cited by examiner

*Primary Examiner*—Tan Ho
(74) *Attorney, Agent, or Firm*—John F. McCabe

(57) ABSTRACT

An apparatus includes an object and one or more sensors located adjacent to or in the object. The object is formed of a material whose dielectric constant or magnetic permeability has a negative real part at microwave-frequencies. The one or more sensors are located adjacent to or in the object and measure an intensity of an electric or a magnetic field therein.

15 Claims, 2 Drawing Sheets

RESONANT ANTENNAS

This application claims the benefit of U.S. Provisional Patent Application No. 60/313,310, filed Aug. 17, 2001.

BACKGROUND OF THE INVENTION

1. Field of the Invention

The inventions relate to antennas and microwave transceivers.

2. Description of the Related Art

Conventional antennas often have linear dimensions that are of order of the wavelength of the radiation being received and/or transmitted. As an example a typical radio transmitter uses a dipole antenna whose length is about equal to ½ of the wavelength of the waves being transmitted. Such an antenna length provides for efficient coupling between the antenna's electrical driver and the radiation field.

Nevertheless, antennas whose linear dimensions are of order of the radiation wavelength are not practical in many situations. In particular, cellular telephones and handheld wireless devices are small. Such devices provide limited space for antennas. On the other hand, small antennas couple inefficiently to the radiation at wavelengths often used in cellular telephones and handheld wireless devices.

SUMMARY OF THE INVENTION

Various embodiments use antennas that resonantly couple to external radiation at communication frequencies. Due to the resonant coupling, the antennas have high sensitivities to the radiation even if their linear dimensions are much smaller than ½ the radiation's wavelength.

In one aspect, the invention features an apparatus that includes an object and one or more sensors located adjacent to or in the object. The object is formed of a material whose dielectric constant or magnetic permeability has a negative real part at microwave frequencies. The one or more sensors are located adjacent to or in the object and measure an intensity of an electric or a magnetic field therein.

In another aspect, the invention features a method. The method includes exciting an object by receiving microwave radiation and detecting a field intensity internal or adjacent to the object in response to the object being excited by the microwave radiation. The object has either a dielectric constant with a negative real part at microwave frequencies or a magnetic permeability with a negative real part at microwave frequencies.

DETAILED DESCRIPTION OF THE EMBODIMENTS

Various embodiments include antennas fabricated of man-made metamaterials for which the dielectric constant ($\epsilon$) and/or magnetic permeability ($\mu$) is negative over a range of microwave frequencies. The metamaterials are selected to cause the antennas to couple resonantly to external radiation having communication frequencies. Due to the resonant couplings, the antennas have a high sensitivity to the radiation even though their linear dimensions are much smaller than the wavelength of the radiation.

The resonant coupling results from selecting the metamaterial to have appropriate $\epsilon$ and/or $\mu$ values. An appropriate selection of the metamaterial depends on the shape of the object and the frequency range over which a resonant response is desired. For spherical antennas $\epsilon$ and/or $\mu$ must have real parts approximately equal to "−2" in the frequency range, i.e., at communication frequencies. For such values of $\epsilon$ and/or $\mu$, a spherical antenna is very sensitive to external radiation even if its diameter is much smaller than ½ of the radiation wavelength.

Figure 1:
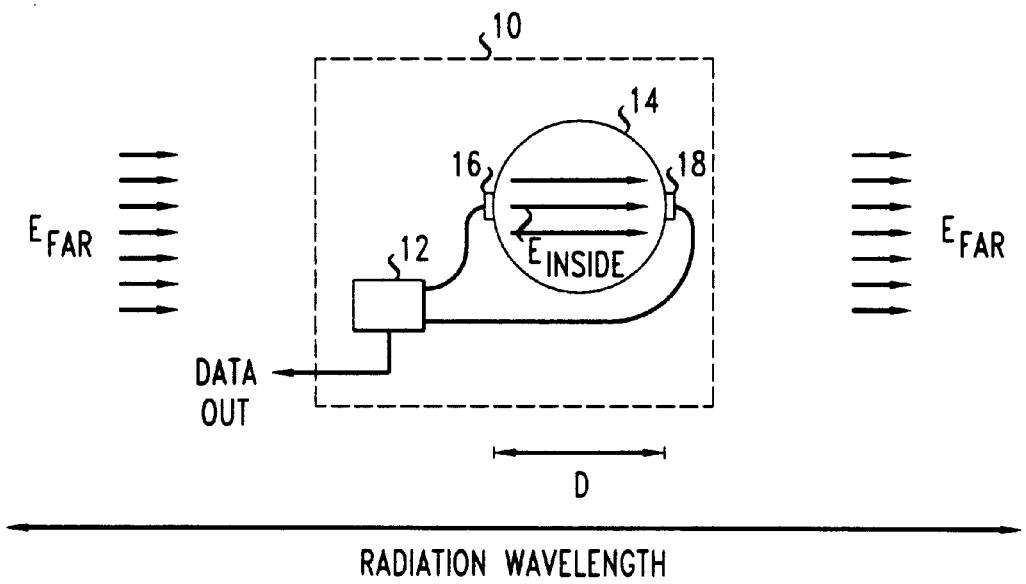
FIG. 1 shows a receiver that includes a resonant dielectric antenna.

FIG. 1 shows a microwave receiver 10 based on a dielectric antenna 14. The receiver 10 includes an amplifier module 12 and the dielectric antenna 14. The amplifier module 12 measures the voltage between electrodes 16, 18 that are located adjacent to opposite poles of the dielectric antenna 14. The voltage measured by the electrodes 16, 18 is representative of the intensity of the field inside the dielectric antenna 14, because the voltage responds resonantly to external fields over the same frequency range for which the antenna 14 responds resonantly. Exemplary electrodes 16, 18 are thin or wire mesh devices that minimally perturb the electric field inside the dielectric antenna 14. The diameter of the antenna 14 is, preferably, 0.2 or less times the wavelength of radiation at a frequency that the amplifier module 10 is configured to amplify.

For the small antenna 14, standard electrostatic theory defines how the antenna responses to externally applied radiation. At distances, D, much larger than the antenna's diameter, S, and much smaller than ¼ of the radiation wavelength, the external electric field, $E_{far}$, is approximately spatially constant and parallel. The field, $E_{far}$, is constant and parallel at distances, D, because the radiation wavelength is much larger than D, and the external electric field, $E_{far}$, only substantially varies for distances as large or larger than ¼ of the radiation wavelength.

For the antenna 14, electrostatics theory determines how the value of the electric field, $E_{inside}$, inside antenna 14 depends on the value of the spatially constant external electric field, $E_{far}$, i.e., the field at distances large compared to D and small compared to the wavelength. If the antenna 14 has a dielectric constant, $\epsilon$, that is substantially constant near the relevant radiation frequency, electrostatics implies that:

$$E_{inside}=(3/[\epsilon+2])E_{far}.$$

From this electrostatics result, one sees that $E_{inside}\rightarrow\infty$ as $\epsilon\rightarrow-2$. Thus, even a small external electric field $E_{far}$ produces a large voltage across electrodes 16, 18 if the antenna's "$\epsilon$" is close to −2. Such a value of $\epsilon$ produces a resonant response in the antenna 14 and makes the receiver very sensitive to external radiation. Thus, producing a resonant antenna 14 requires constructing a metamaterial whose E has an appropriate value in the desired communications band.

Available materials do not have a dielectric constants equal to −2. Rather composite materials can de fabricated to have an E whose real part is close to −2 over a limited frequency range. The appropriate metamaterials have negative $\epsilon$'s for appropriate frequencies in a microwave range, e.g., from about 1 giga-hertz (GHz) to about 100 GHz.

Manmade metamaterials that have appropriate properties in portions of the above-mentioned frequency range are well-known in the art. Some such metamaterials are described in "Experimental Verification of a Negative Index of Refraction", by R. A. Shelby et al, Science, vol. 292 (2001) 77. Various designs for such metamaterials are provided in "Composite Medium with Simultaneously Negative Permeability and Permeability", D. R. Smith et al, Physical Review Letters, vol. 84 (2000) 4184 and "Microwave transmission through a two-dimensional, isotropic, left-handed metamaterial", by R. A. Shelby et al, Applied Physics Letters, vol. 78 (2001) 489. Exemplary designs produce metamaterials having $\epsilon$ and/or $\mu$ with negative values at frequencies in the ranges of about 4.7–5.2 GHz and about 10.3–11.1 GHz.

Various designs for 2- and 3-dimensional manmade objects of metamaterials include 2- and 3-dimensional arrays of conducting objects. Various embodiments of the objects include single and multiple wire loops, split-ring resonators, conducting strips, and combinations of these objects. The exemplary objects made of one or multiple wire loops have resonant frequencies that depend in known ways on the parameters defining the objects. The dielectric constants and magnetic permeabilities of the metamaterials depend on both the physical traits of the objects therein and the layout of the arrays of objects. For wire loop objects, the resonant frequencies depend on the wire thickness, the loop radii, the multiplicity of loops, and the spacing of the wires making up the loops. See e.g.,; "Loop-wire medium for investigating plasmons at microwave frequencies", D. R. Smith et al, Applied Physics Letters, vol. 75 (1999) 1425.

After selecting a frequency range and $\epsilon$ and/or $\mu$, the appropriate parameter values for the objects and arrays that make up the metamaterial are straightforward to determine by those of skill in the art. See e.g., the above-cited references. The useful metamaterials have a dielectric constant and/or magnetic permeability whose real part is negative at the desired microwave frequencies.

Since real materials cause losses, metamaterials typically have an $\epsilon$ and/or a $\mu$ with a nonzero imaginary part. For such resonant behavior, the imaginary part of dielectric constant and/or magnetic permeability must be small enough to not destroy the resonant response of the antenna and large enough to provide adequate breadth to the resonant response. Typically, one desires a resonant response over a band of frequencies. Methods for introducing losses into the metamaterials are also known to those of skill in the art. See e.g., the above-mentioned References.

Figure 2:
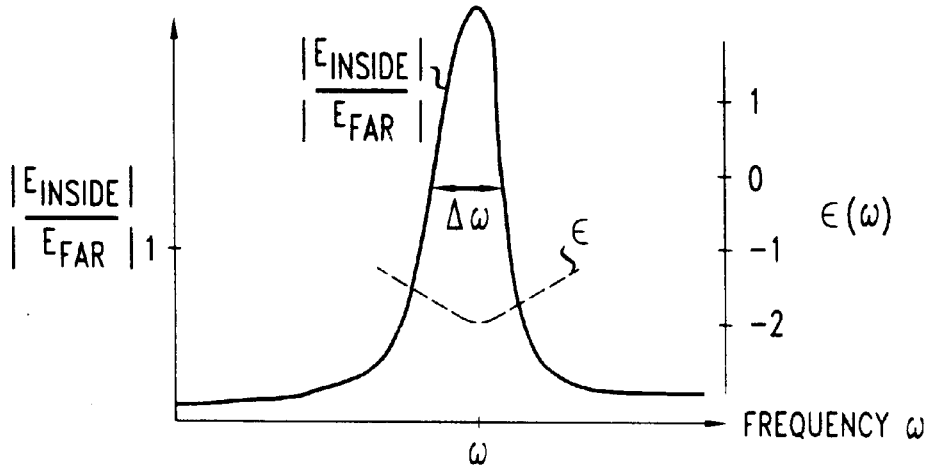
FIG. 2 plots the response of an exemplary spherical dielectric antenna as measured by two electrodes adjacent opposite poles of the antenna.

At frequencies that produce resonant responses in antenna 14, the nonzero imaginary part of $\epsilon$ reduces the infinite response to an external electric field to a finite peak with a frequency spread as seen in FIG. 2. Preferred receivers 10 employ metamaterials whose $\epsilon$ has a larger enough imaginary part to insure that the desired communication band provokes a resonant response in the antenna 14. Known metamaterials produce values of $\mathrm{Im}[\epsilon(\omega)]/\mathrm{Re}[\epsilon(\omega)]=\Delta\omega/\omega \geqq 0.03\text{–}0.05$ and $\leqq 0.1$.

Figure 3:
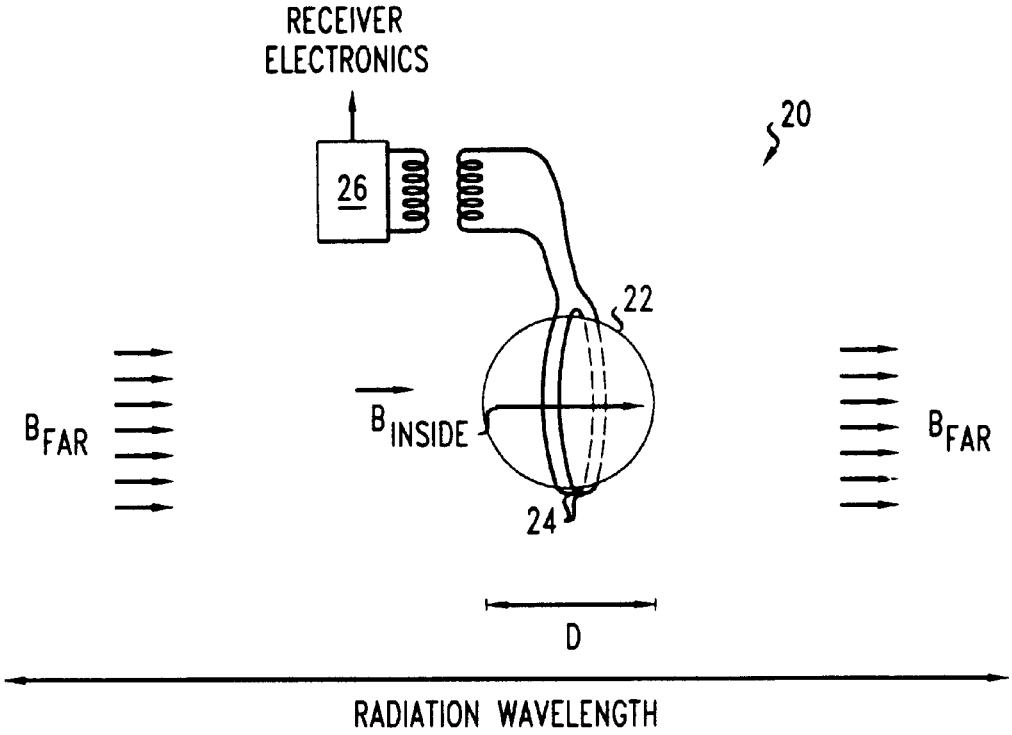
FIG. 3 shows a receiver that includes a resonant magnetically permeable antenna.

FIG. 3 shows a receiver 20 based on a magnetically permeable spherical antenna 22. The receiver 20 also includes a pickup coil 24, and an amplifier module 26. The antenna 22 is constructed of a magnetic metamaterial with an appropriate $\mu$. In the antenna 22, the magnetic permeability, $\mu$, rather than dielectric constant $\epsilon$ causes a resonant response to external radiation. For the antenna 22, magnetostatics rather than electrostatics enable relating a magnetic field inside the antenna, $B_{inside}$, to an external magnetic field, $B_{far}$. Provided that the external magnetic field, $B_{far}$, has a wavelength large compared to the diameter of the antenna 22, magnetostatics implies that:

$$B_{inside}=(3\,\mu/[\mu+2])B_{far}.$$

If $\mu$ has a value close to "−2" in a desired frequency range, the spherical antenna 22 produces a resonant response to externally applied radiation. In such a case, the antenna 22 greatly increases the sensitivity of receiver 20 to applied external radiation.

Again, the magnetically permeable metamaterial has a $\mu$ whose imaginary part is nonzero due to internal losses. The imaginary part of $\mu$ is designed to be large enough to insure that the antenna 22 responds resonantly over a desired frequency band. Methods for introducing losses into metamaterials are known to those of skill in the art.

While the above-described receivers 10, 20 use spherical antennas 14, 22, other embodiments use antennas with different shapes. Exemplary antenna shapes include ellipsoids, cylinders, and cubes. For these other shapes, the associated antennas resonantly respond to external radiation for values of the real part of an $\epsilon$ and/or $\mu$ that differ from "−2". The parameters for the metamaterial depend on the geometry of the antenna and are selected to provide an appropriate negative value of $\epsilon$ and/or $\mu$ in an appropriate microwave band.

Figure 4:
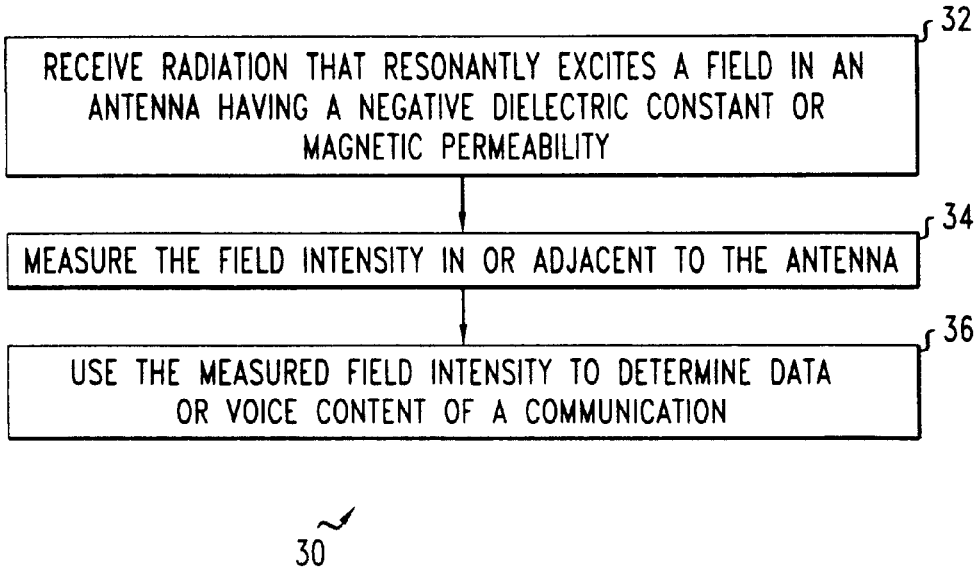
FIG. 4 is a flow chart illustrating a method for receiving wireless communications with receivers of FIG. 1 or FIG. 3.

FIG. 4 illustrates a method 30 for receiving wireless data or voice communications with receiver 10 of FIG. 1 or receiver 20 of FIG. 3. The method 30 includes receiving microwave radiation that resonantly excites an electric or magnetic field intensity in an antenna (step 32). The antenna has either a dielectric constant with a negative real part at microwave frequencies or a magnetic permeability with a negative real part at microwave frequencies. Exemplary antennas include objects made of metamaterials. In response being excited, the intensity of the electric or magnetic field in or adjacent to the antenna is measured (step 34). The field intensity is measured by one or more sensors that are located internal to or adjacent to the antenna The method 30 includes using the measured field intensity to determine data or voice content of a communication transmitted in a preselected frequency range (step 36).

The invention is intended to include other embodiments that will be obvious to one of skill in the art in light of the disclosure, figures and claims.

What we claim is:

1. An apparatus, comprising:

an object formed of a material in which one of the dielectric constant and the magnetic permeability has a value with a negative real part at microwave frequencies; and one or more sensors located adjacent to or in the object and configured to measure an intensity of an electric or magnetic field therein; and wherein the value of the real part causes the object to respond resonantly to external electric or magnetic fields.

2. The apparatus of claim 1, wherein the material is a metamaterial.

3. The apparatus of claim 2, further comprising:

a microwave receiver, the object and one or more sensors configured to function as an antenna for the receiver.

4. The apparatus of claim 3, further comprising:

an amplifier that is coupled to the one or more sensors and is configured to amplify signals at microwave frequencies.

5. The apparatus of claim 3, further comprising:

a cellular telephone or handheld wireless device, the microwave receiver configured to receive communications for the cellular telephone or handheld wireless device.

6. The apparatus of claim 1, wherein one of the sensors is located adjacent an external surface of the object.

7. The apparatus of claim 1, wherein the one or more sensors is positioned to measure a resonant response to external fields having wavelengths in a preselected range, the wavelengths being longer than the linear dimensions of the object.

8. The apparatus of claim 1, wherein the object is substantially spherical and the real part is equal to $-2\pm0.2$ at a microwave frequency.

9. The apparatus of claim 1, further comprising:

an amplifier configured to generate electrical signals in the one or more sensors at a microwave frequency.

10. The apparatus of claim 1, wherein the object is shaped like one of a cube and a cylinder.

11. A method, comprising:

exciting an object by receiving microwave radiation therein, the object being formed of a material in which one of a dielectric constant and a magnetic permeability has a value with a negative real part at microwave frequencies; and detecting a field intensity internal or adjacent to the object in response to the object being excited by the microwave radiation; and wherein the receiving produces a resonant response in one of a magnetic field intensity in the object and an electric field intensity in the object.

12. The method of claim 11, wherein the detected field intensity is a magnetic flux.

13. The method of claim 11, wherein the detected field intensity is a voltage.

14. The method of claim 11, wherein the object comprises a metamaterial.

15. The method of claim 11, wherein the detecting further comprises:

measuring a resonant response in the object to external fields having wavelengths in a preselected communication range, the wavelengths being longer than the linear dimensions of the object.

* * * * *